United States Patent [19]

Joy

[11] Patent Number: 4,526,013

[45] Date of Patent: Jul. 2, 1985

[54] ENVIRONMENTAL PROTECTION SYSTEM

[75] Inventor: John R. Joy, Brighton, Mich.

[73] Assignee: Williams International Corporation, Walled Lake, Mich.

[21] Appl. No.: 434,857

[22] Filed: Oct. 18, 1982

[51] Int. Cl.[3] ..... F25B 27/00; F25B 27/02

[52] U.S. Cl. ..... 62/236; 62/238.4

[58] Field of Search ..... 62/238.4, 236; 60/618

[56] References Cited

U.S. PATENT DOCUMENTS

| | | | |
|---|---|---|---|
| 2,952,138 | 9/1960 | Russell et al. | 62/238.4 |
| 3,153,442 | 10/1964 | Silvern | 62/238.4 X |
| 3,470,707 | 10/1969 | Lofgreen et al. | 62/238.4 X |
| 4,010,378 | 3/1977 | Tharpe et al. | 62/236 X |
| 4,347,711 | 9/1982 | Noe et al. | 62/238.4 X |

*Primary Examiner*—Lloyd L. King

*Attorney, Agent, or Firm*—Lyman R. Lyon

[57] ABSTRACT

The disclosure relates to an environmental protection system comprising a Rankine cycle power loop wherein a working fluid is heated by either the combustion of a fuel or by heat exchange from internal combustion engine exhaust. A high frequency turboalternator is driven by the power loop working fluid for the production of high frequency alternating current. An electrically driven Rankine cycle cooling loop uses a second working fluid to effect cooling of a desired media.

1 Claim, 1 Drawing Figure

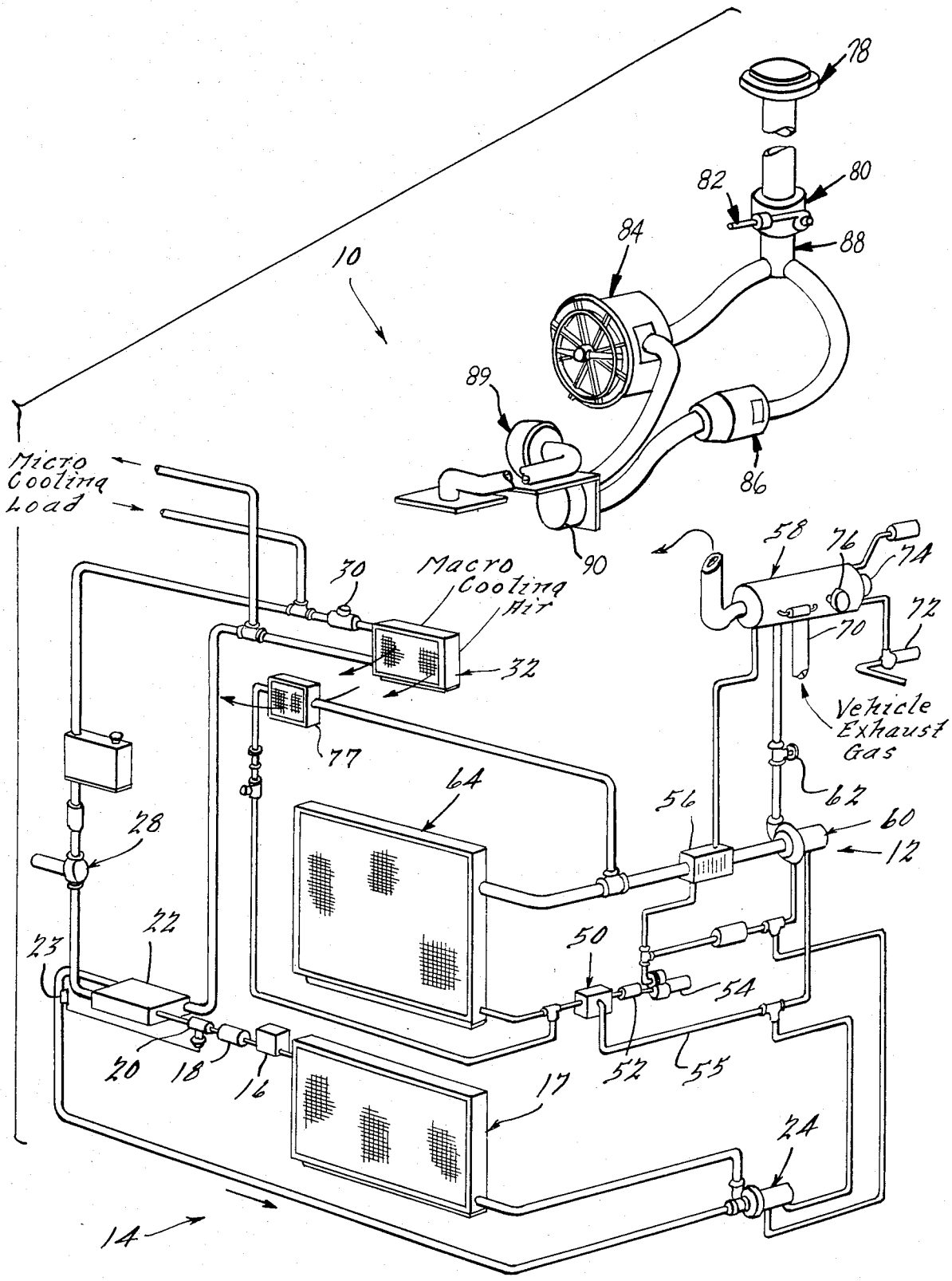
10
78
80
82
88
84
89
86
90
Micro Cooling Load
Macro Cooling Air
30
32
77
58
76
74
72
70
Vehicle Exhaust Gas
62
60
12
56
64
28
22
23
20
18
16
17
50
54
52
55
24
14

ENVIRONMENTAL PROTECTION SYSTEM

BACKGROUND OF THE INVENTION

Combat vehicles are highly mobile, manned, protected, ground weapon systems designed and intended for an active, offensive combat role on the land battlefield. They are employed in direct contact with the enemy or, as in the case of artillery, in close support of the ground battle. However, when such combat vehicles are employed directly in the ground battle or immediately to the rear thereof, they are subject, with little or no warning, to engagement with hostile aircraft. Since such vehicles may find themselves engaged in direct, close combat, they must be equipped to engage in battle in any environment.

In the event an enemy resorts to the offensive use of radiological and chemical agents, such vehicles must be provided with an environmental protection system to enhance survivability under conditions of nuclear, biological and chemical warfare. An optimum system for combat vehicles is the hybrid collective protection concept which combines a positive pressure, pollutant-free environment within the crew compartment with individual crewman protective equipment, together with appropriate detector and alarm devices. Individual equipment, for example, suits, gloves, boots and a ventilated facepiece is to be used when by necessity hatches must be opened in a hostile environment. Otherwise, the crew compartment collective protection will permit the crew to operate with hatches closed without the degrading influences of face masks, gloves and boots.

SUMMARY OF THE INVENTION

A crew compartment collective protection system in accordance with the instant invention is rendered independent of the vehicle's main engine and electrical system by using a fuel-fired burner vapor generator, operating on vehicular fuel, together with a working fluid in a Rankine cycle to drive a small turboalternator. The turbine drives a high frequency, three phase, permanent magnet alternator. The alternating current thus produced is used to operate the pressurization/ventilation/-filtration subsystem's blowers and controls, a refrigerant compressor, condenser fan, pumps and controls. Cooling is required because of excessive heat loads, found in an armored vehicle when closed in hot climates and, additionally, when the crews must operate in individual protective suits. Because a considerable amount of heat must be rejected in the Rankine cycle, such heat may be used to eliminate the separate fuel-fired crew compartment heater, together with its associated cost and space claim. The burner vapor generator normally will be operated partially or wholly by engine exhaust gas heat and has the potential of acting as a muffler.

The refrigerant, R113, is cycled by a small centrifugal compressor, directly driven by an induction motor. The latter cools an ethylene glycol/water mixture which mixture passes through a heat exchanger for cooling the crew compartment or the individual suits, providing a dual cooling system (macro/micro). Alternatively, the micro cooling system may use air as a coolant, eliminating the ethylene glycol/water system.

The working fluids exhibit very low toxicity and are non-flammable. Individual components are relatively small and separable, thus can be distributed in locations wherever adequate space is available. The system provides flexibility for installation in a variety of combat vehicles through its potential of adding or resizing individual components only as needed.

Field protection against nuclear, biological, and chemical (NBC) warfare agents includes removal of both particulate and gaseous forms of toxic agents dispersed in the air.

Chemical agents are dispersed either as gases or aerosols. Activated charcoal filters remove toxic gases from the air. Aerosols are collected on particulate filters placed ahead of gas filters in a filtration train. Particulate filters remove both solid particles and liquid droplets from the air, but allow the gases generated by vaporizing chemical aerosols to pass through to the gas filter for removal.

Biological agents are dispersed as solid dry particles, or encased in liquid droplets. Both forms are removed by particulate filters.

Radiological dust presents radiation hazards of varying intensity. Complete protection against this danger requires use of extensive shielding. The particulate filter removes the dust particles and prevents inhalation of radioactive dust by personnel. In addition, the collective protection equipment includes continuous automatic exhausting of separated dust to prevent carrying it into the crew compartment during bypass ventilation mode or prevent a large build-up of radioactive dust on the particulate filter.

A ventilated facepiece or ventilated headpiece is used to provide protection against chemical agents on an individual basis. This method of protection includes a relatively small gas particulate filter unit to supply filtered air, via hoses, to facepieces or headpieces worn by personnel within the vehicle. In crew compartments, protection is provided by positive pressure collective protection equipment integrated with environmental control units. Thus, the crew compartment is provided with a "shirt-sleeve" atmosphere within which personnel can function with complete freedom of movement and communication. This environment is made possible by removing dust from ventilation air, pressurizing the interior of the vehicle, and heating or cooling as required. Because the atmosphere in the vehicle is automatically maintained at a higher pressure then the outside atmosphere, clean air flows outward through structural leakage paths, thereby preventing infiltration of airborne contaminants.

In the event of an NBC attack, positive pressure collective protection for personnel in a vehicle can be provided in a matter of seconds simply by closing all entries and ports, and switching operation from ventilation to NBC collective protection mode. After contamination of the outside atmosphere has subsided and the outside of the vehicle has been decontaminated, the system normal operations continue without decontaminating the interior of the vehicle and associated equipment.

BRIEF DESCRIPTION OF THE DRAWINGS

The drawing comprises a diagrammatic view of the environmental protection system of the instant invention.

DETAILED DESCRIPTION OF THE PREFERRED EMBODIMENT OF THE INVENTION

An environmental protection system 10 in accordance with the instant invention can be divided into two separate systems, namely, a power system 12 and a refrigerant system 14. The power system 12 extracts heat from the vehicle powerplant exhaust or from the combustion of fuel from the vehicle fuel tanks. This heat is then converted to electric power by a turbine driven alternator producing up to 10 Kw. The power cycle also provides up to 100,000 BTU/hr of heating.

The refrigerant cycle provides air conditioning for the crew compartment and/or the individual protective suits when they are attached to the system. The electric power required to drive the refrigerant compressor is the main link between the two systems. The separation of turbine and compressor and the electric link constitute the split system.

Referring to the drawing, the vapor refrigeration cycle 14 operates in a Rankine cycle with R113 as the primary working fluid. R113 leaves a refrigerant receiver/reservoir 16 as a high pressure saturated liquid and passes through a dryer unit 18 before entering an expansion valve 20.

The freon receiver/reservoir 16 is sized to contain an adequate amount of working fluid for the refrigeration system plus adequate empty volume to accommodate excess quantities of working fluid as system flow changes to meet cooling demands. Provisions for a Freon storage area are necessary to prevent Freon from piling up in a condenser 17, to be described, which would reduce the effective condensing surface.

The purpose of the filter/dryer 18 is to filter the working fluid and to remove water from the system in order to prevent freeze-up. The dryer contains a screen filter element (typically 20 microns) surrounded by a suitable desiccant material.

The expansion valve 20 serves as the pressure barrier between the high operating pressure of the condenser 17 and the lower operating pressure of the evaporator 22. The evaporator 22 exit temperature is sensed by a remote temperature bulb 23 attached to the expansion valve 20.

Since the expansion valve 20 throttles the working fluid to the evaporator 22, the fluid entering the evaporator 22 is in a two-phase condition. In the evaporator 22 the liquid phase is vaporized at constant pressure and temperature and the latent heat or vaporization cools the incoming warm ethylene glycol/water secondary working fluid.

The vapor which leaves the evaporator 22 is thereafter compressed to condenser pressure by a combination refrigerant compressor high speed three phase induction motor 24. The compressor 24 is driven by a motor sized to provide the necessary starting torque to drive the compressor on an "on-off" basis. The speed of the refrigerant compressor 24 is governed by the turboalternator output frequency the ratio of the number of poles of the two devices and the shp. Anticipated efficiencies are 75% for the compressor 24 and 80% for the induction motor thereof. The R113 working fluid leaves the compressor 24 in the superheated vapor condition.

The R113 working fluid is then cooled and condensed at substantially constant pressure to the saturated liquid condition in the condenser 17 using ambient air to remove the heat. The purpose of the refrigerant condenser 17 is to condense the R113 back to its saturated liquid state through the removal of heat. Ambient air, circulated through the condenser 17 is the heat sink.

The cycle is then completed as saturated liquid from the condenser 17 enters the receiver/reservoir 16. In summary, the cycle absorbs heat at low temperature in the evaporator 22 and rejects this heat plus the refrigerant compressor 24 power at high temperature in the condenser 17.

External power is required to drive the refrigerant compressor 24 and a circulating pump 28 which circulates the crew compartment cooling media to the evaporator 22.

Control of the refrigeration cycle is achieved by starting or stopping the R113 primary fluid compressor 24 as required. A conventional thermostatic device can be used to cycle the system on and off to maintain the selected temperature.

Should micro-cooling alone be desired, closure of a micro-cooling zone valve 30 will divert all or part of the fluid in the cooling loop to the micro-cooling loads. The 60,000 BTU/hr cooling capability at the evaporator 22 may be utilized in a variety of different ways to provice micro-cooling, macro-cooling or, a system that meets the requirements of both since the evaporator 22 transfers heat from a secondary fluid which in turn is circulated throughout the secondary cooling loop by the small secondary working fluid circulation pump 28 at a rate which is adequate to service the micro or macro system or any combination thereof. The circulation pump 28 is powered by a 1/12 HP 28 VDC motor. The cooling loop includes a micro-cooling manifold in the crew compartment, not shown, into which individual cooling vests are interconnected and a 60,000 BTU/hr cooler exchanger 32 which provides the macro-cooling capability. The required airflow rate over the cooler exchanger 32 into the crew compartment is, for example, 840 SCFM, 300 SCFM being pressurizing air with the balance (540 SCFM) being recirculated crew compartment air. The crew has the option of selecting the type of cooling desired by virtue of the micro-cooling zone valve 30. With the valve open both macro and micro cooling capability exits. With the valve closed, no fluid circulates through the cooler exchanger 32 and the micro-cooling manifold in the crew compartment may be utilized at will.

The power system 12 is a Rankine cycle system adapted to effect waste heat recovery or operate with auxiliary fuel, and exhibiting relatively high efficiency and low complexity. The power cycle system produces an electrical output of 10 Kw at 125° F. ambient temperature.

The Rankine cycle power system 12 is depicted schematically and operates with Fluorinal 85 as the working fluid. Fluorinal 85, at a low pressure, low temperature saturated, liquid state, is drawn from a Fluorinol 85 reservoir 50 that is sized to contain an adequate amount of working fluid for the power. The reservoir 50 also contains adequate empty volume to accommodate excess working fluid as system loading changes to meet power demands. This is necessary to prevent Fluorinol 85 liquid from accumulating in the condenser (to be described) which would materially reduce the condenser effectiveness. The reservoir 50 may also contain a provision for a lubrication scavenge return line 55 for Fluorinal 85 which could be diverted from the main cycle flow for the purpose of lubrication.

The high pressure or boiler feed pump 54 is designed to handle flow rates in the range of 0.07 to 2.6 gallons per minute while pumping into approximately a 600 psia head. The feed pump 54 is designed for high V/L operation and low inlet pressure. It is driven by a ¼ hp 28 volt DC motor designed for variable speed operation.

Fluorinal 85 is raised to boiler pressure in the pump 54, and then passes through a regenerator heat exchanger 56 before entering a burner vapor generator 58. The regenerator 56 is a heat exchanger that utilizes the hot super-heated vapor discharged from a turboalternator 60 to heat the relatively cool Fluorinal 85 prior to entering the burner vapor generator 58. The heat exchanger 56 serves two important functions: (1) it reduces the condenser heat load by removing some of the superheat from the turbine discharge gas, and (2) it reduces the burner vapor generator input heat requirements by heating the cool liquid entering the burner vapor generator 58. Both effects result in reduction of the size and the weight of the appropriate heat exchangers and increase to the overall cycle efficiency. Typical heat transfer rates in the regenerator 56 approach 93,000 BTU/hr, which to give an example, reduces the fuel flow requirement to the vehicle engine necessary to produce 10 Kw from 15 LB/HR to 11 LB/HR. The regenerator 56 is a plate fin design of aluminum construction.

The purpose of the burner vapor generator 58 is to supply superheated vapor to a turboalternator 60. During the vehicle powerplant operation, the burner vapor generator 58 will gain some or all of the heat required from the engine exhaust. When the vehicle powerplant is not operating, or when its exhaust energy is insufficient, the burner vapor generator 58 will gain the required heat from an integral fuel combustor. A 5" ID exhaust pipe 70 enters the vapor generator 58 near its midpoint and conducts exhaust thereinto.

The burner vapor generator 58 follows a design approach successfully employed in gasoline and diesel fueled steam engines developed under DOE and US Bureau of Mines R & D programs by Advanced Mechanical Technologies Incorporated. Combustion occurs in an intense zone immediately downstream of the perforated flame holder and produces combustion products which are essentially soot-free. While not shown in detail, the combustor of the burner vapor generator 58 is an all-metal structure, requiring no refractory materials. All surfaces exposed to combustion products are air-cooled, and nickel alloys, such as Inconel-X, provide sufficient heat resistance. Downstream of the combustor, the transition section between the combustor and the heat exchanger requires refractory insulation. Also, the section of exhaust pipe 70 in this zone requires a heat-resistant refractory alloy or ceramic to withstand the high temperature encountered when the vehicle engine is not running.

An air inlet 76 to the combustor to equipped with a throttle valve (not shown) which also serves to prevent backflow through the combustor when the vapor generator 58 is operating on vehicle powerplant exhaust alone. The air throttle valve is be used to control air flow rate at low loads and when the vehicle powerplant is not operating. With the addition of pressure taps on either side of the air throttle, the valve could also serve as an air-flow meter to provide the air-flow signal that may be necessary for proper air/fuel ratio control.

It is to be noted that the regenerator 56 improves overall cycle efficiency by allowing the burner vapor generator 58 feed flow to absorb the thermal energy released while desuperheating the vapor emerging from the turbine of the turboalternator 60.

In the burner vapor generator 58, the working fluid is heated to a vapor state and then superheated by heat input thereto. The thermal input to this unit comes from one of a combination of two sources, host vehicle main power plant exhaust or combustion of diesel fuel in the combustor section of the burner vapor generator. The heat input is regulated by controlling the flow of exhaust gases and the rate of fuel flow to the combustor.

Superheated vapor exiting the burner vapor generator 58 passes through a throttle valve 62 prior to entering the turbine of the turboalternator 60. Superheated vapor entering the turbine is expanded to condenser pressure and useful work is extracted from the fluid by the turbine to drive the alternator. The purpose of the throttle valve 62 at the inlet to the turboalternator 60 is to maintain turboalternator speed (frequency) constant over a wide variety of alternator loads.

The turboalternator 60 extracts energy from the superheated fluorinol exiting the burner vapor generator 58 and converts this energy to electrical energy. The turboalternator 60 is designed to deliver up to 10 kilowatts of electrical power.

The turbine is designed to produce up to 15 HP from the expanding vapor. Turbine efficiencies in the area of 80 percent are obtainable.

The alternator is coupled to the turbine by a common shaft. The alternator is a 6 pole, 3 phase unit designed to produce up to 10 KWe at 110 VAC at a design speed of 75,000 RPM (3,750 Hz). Alternator efficiencies are in the 90–93 percent range.

Vapor leaving the turboalternator 60, still in a superheated condition, again passes into the regenerator 56 where it gives up some of its heat to the liquid entering the burner vapor generator 58.

Vapor exiting the regenerator 56 at a low pressure in a slightly superheated condition passes to a main power condenser 64 where some of its heat is transferred to outside air.

The purpose of the power condenser 64 is to cool and condense the superheated Fluorinol 85. Ambient air, circulated through the condenser 64 is the heat sink.

The fluid leaving the power condenser 64 is in the form of saturated liquid and may even be slightly subcooled. The cycle is then completed as liquid from the condenser 64 enters the reservoir 50. In summary, This cycle absorbs heat at high temperature in the burner vapor generator 58 and rejects this heat minus the power output of the turbine 60 plus the power input of the pump 54 at low temperature in the condenser 64. Input power is required to drive the high pressure pump 54.

For purposes of crew compartment heating, a heat exchanger 77 is connected in parallel with the condenser 64.

With respect to pressurization, ventilation and filtration of the crew compartment, the system of the instant invention comprises a protective air inlet 78 including a rain shield, a ballistic shield, and a deep fording valve. The air inlet 78 protects the filtering system against physical damage from ingesting large amounts of water or foreign objects while the unit is in operation or in storage. A snorkel may also be used to extend the air inlet location some distance above the vehicle.

A primary fan 80 moves air through a dust separator 82 and then either through an NBC collective protection filter 84 or a ventilation bypass blower 86 to pressurize the vehicle crew compartment.

The dust separator 82 is an internal separator that removes approximately 92 percent of all particulate matter and liquid from the incoming air before it reaches the filter/ventilation bypass valve. The separated contaminants are continually exhausted to the outside atmosphere. Use of the dust separator 82 minimizes ingestion of dust into the vehicle and greatly prolongs the service life of the particulate filter 84.

The particulate portion of the filter 84 contains pleated glass-fiber filter media that removes a minimum of 99.97 percent of all particulate matter and liquid drops remaining in the airstream after passage through the dust separator 82. The gas filter portion of the filter 84 contains activated charcoal granules that remove gaseous toxic agents from the airstream before the air is delivered to the protected enclosure.

An operational mode selector 88, either manual or automatic, contains a bypass valve to operate the system in either the ventilation mode or the NBC collective protection mode.

A recirculation blower 89 having a flow modulation valve 90 provides air movement within the vehicle.

From the foregoing description it should be apparent that the crew compartment collective protection system of the instant invention is independent of the vehicle's main engine and electrical system. The system uses a fuel-fired burner vapor generator, operating on vehicular fuel, together with a working fluid in a Rankine cycle to drive a small turboalternator. The alternating current thus produced is used to operate the pressurization/ventilation/filtration subsystem's blowers and controls, a refrigerant compressor, condenser fan, pumps and controls.

Cooling of the crew compartment is provided by a refrigerant that is cycled by a small centrifugal compressor through an evaporator chiller. The latter cools an ethylene glycol/water mixture which is used as a coolant for individual suits or utilized in a heat exchanger.

The system provides protection against nuclear, biological, and chemical warfare agents by removal of both particulate and gaseous forms of toxic agents dispersed in environmental air.

While the preferred embodiment of the invention has been disclosed, it should be appreciated that the invention is susceptible of modification without departing from the scope of the following claims.

I claim:

1. An environmental conditioning system for a vehicle having an internal combustion engine with an exhaust outlet comprising:

a closed Flourinal 85 power and heating circuit including a vapor generator for the vaporization of Fluorinal 85 by the combustion of a fuel and by heat exchange from the internal combustion engine exhaust, selectively, a turboalternator connected to said vapor generator and driven by said Flourinal 85 for the production of alternating current, a regenerator connected to the exhaust side of said turboalternator, a condenser connected to said regenerator, and a Fluorinal 85 reservoir connected between said condenser and vapor generator including a conduit passing through said regenerator, a closed Freon 113 cooling circuit including an electric motor driven by alternating current from said turboalternator, a compressor for said Freon 113 driven by said electric motor, a condenser connected to said compressor, an expansion valve connected to said condenser, and a dual purpose evaporator and heat exchanger connected between said expansion valve and said compressor, and a closed ethylene-glycol-water cooling circuit comprising the heat exchanger portion of said dual purpose evaporator and heat exchanger, a pump connected to said evaporator, valve means connected to said pump for controlling flow of the etheylene-glycol-water in said cooling circuit, and a heat exchanger connected between said valve and said evaporator.

* * * * *